United States Patent [19]

Baker et al.

[11] 4,449,944

[45] May 22, 1984

[54] VARIABLE INLET HYDROJET BOAT DRIVE

[75] Inventors: Kenneth R. Baker, Woodland Hills; Robert T. De Vault, Simi Valley, both of Calif.

[73] Assignee: Maritec Corporation, Canoga Park, Calif.

[21] Appl. No.: 591

[22] Filed: Jan. 2, 1979

[51] Int. Cl.[3] ..... B63H 11/04

[52] U.S. Cl. ..... 440/47; 440/41

[58] Field of Search ..... 60/221, 222; 440/38, 440/40–43, 47

[56] References Cited

U.S. PATENT DOCUMENTS 3,109,407 11/1963 Dorst ..... 115/14

3,811,397 5/1974 Usborne ..... 115/14

FOREIGN PATENT DOCUMENTS 688611 6/1964 Canada ..... 115/12 R

*Primary Examiner*—Sherman D. Basinger

*Attorney, Agent, or Firm*—William H. Maxwell

[57] ABSTRACT

A hydrojet boat drive for efficient transition from low to high speed boat operation, characterized by a conventional drive pump unit and prime mover installation in the "slot" of a "V" bottomed hull and featuring a low drag ram-scoop with a blow-in door or panel which is responsive to imbalance between internal flow pressure and external slipstream pressure, whereby intake volume is augmented for low speed operation and ram pressures contained for high speed operation.

20 Claims, 4 Drawing Figures

VARIABLE INLET HYDROJET BOAT DRIVE

BACKGROUND

Heretofore, the propulsion water intake for marine jet drives have been a compromise, since the intake of fixed cross sectional capacity has been made large enough for low speed performance and yet small enough for high speed perrormance. This compromise is not conducive to all-out racing or optimum all around performance, because the boat must be accelerated through the low speed barrier with the expectation of subsequent performance at high speed. Although intake scoops have been made to vary in size, jet boat drives have remained restricted in high speed performance, it being a general object of this invention to provide means by which jet driven boats may break away from restricted high speed performance and compete favorably with propeller driven boats that have a substantially high speed restriction.

There are two principle types of intakes for withdrawing water from the slipstream passing along the hull of a boat, the flush opening type and the scoop or ram type. The former is generally employed for the induction of water into jet propulsion drives, and the latter has been proposed but therefor in abortive configurations. The flush intake is efficient enough for moderate performance boats, it has low drag and does not interfere with boat handling. On the other hand, the scoop or ram type of intake is desirable for high speed operation as it provides high intake pressures so that the pump impeller will continue to operate on its performance curve at high speeds. Accordingly, it is an object of this invention to adapt a scoop or ram intake to the flush intake of a boat bottom in combination with a jet drive pump unit.

Experience teaches that larger intake area is required for low speed boat operation, while smaller intake area is required for high speed boat operation. Therefore, a variation in intake area is required for high performance throughout both the low and high speed ranges. For example, if performance is insufficient in the low speed range, the high speed range may not be reached. Accordingly, it is an object of this invention to provide an automatically variable volume propulsion water intake for hydrojet boat drives, having a restrictive ram opening for high speed operation and having a flush secondary opening augmenting the intake water for low speed operation. With the present invention, the intake of slipstream water is modulated dependent upon the speed of boat operation, by means of a pressure responsive panel placed substantially aft of the ram intake leading edge to open into the propulsion water intake passage to the jet pump. That is, the said panel is sensitive to any pressure imbalance so as to allow increased volume flow during low speed conditions. However, as the boat accelerates the said pressure imbalance diminishes and eventually disappears so that the panel is tightly shut so as to close the augmenting opening, whereby ram water only is admitted to the propulsion water intake passage via the aforesaid ram-scoop of optimized area for efficient high speed boat operation. Consequently, there is a minimum drag while providing the required pressure recovery for said high speed operation.

The boat hull is slotted so as to provide a flush opening intake for propulsion water, the slot being characterized by a rearwardly widening tunnel increasing in height as it inclines rearwardly to a rectangular opening at an interface between the boat hull and intake into the hydrojet pump unit. Characteristically therefore, the pump unit intake is rectangular into a plenum that extends rearwardly and around an impeller shaft to fair into a round flow passage. It is the first mentioned widening tunnel and second mentioned faired plenum which are to be modified by the ram-scoop of the present invention, it being an object to restrict the widening of the hull tunnel with a commensurate restriction of the interface opening at the pump unit intake, while fairing the ram scoop into the said plenum for efficient flow of propulsion water therethrough. In practice, the ram-scoop is fastened to both the boat hull and to the hydrojet boat unit, and bonded integrally into working position with epoxy resins or the like which can be made fair with both the hull and said pump unit.

SUMMARY OF INVENTION

This invention relates to a scoop of the ram type for high speed boat operation, and which is adapted to the flush type propulsion water intakes of boat hulls with hydrojet drives. The basic boat hull and jet propulsion drive installation remains substantially unchanged, the scoop adaptation being efficient in combination therewith to enhance performance, whereby both low speed and high speed efficiency is realized. The conventional wide-mount flush opening of slot configuration is at least partially enclosed by a ram-scoop of low profile and minimal intake area for high speed operation. The ram-scoop adapts to the hydrojet pump unit and it is fastened to both the boat hull and to said pump unit, being bonded into working position as by means of epoxy resins. A feature of this ram-scoop is its modification of the conventionally widening intake slot and its reduction of the intake area into the plenum of said pump unit. The ram-scoop is of low profile configuration for minimal drag commensurate with the high speed water intake requirements, there being means for augmenting water intake for low speed requirements. The last mentioned means comprises a flush intake opening into the ram-scoop automatically closed by a panel that opens for low speed operation and which closes for high speed operation, all of which is inherently pressure responsive to the balance of pressures between the internal flow passage and external slipstream. As a result, the hydrojet pump unit is made to operate efficiently throughout both the low speed and high speed ranges of boat operation.

DRAWINGS

The various objects and features of this invention will be fully understood from the following detailed description of the typical preferred form and application thereof, throughout which description reference is made to the accompanying drawings, in which.

Figure 3:
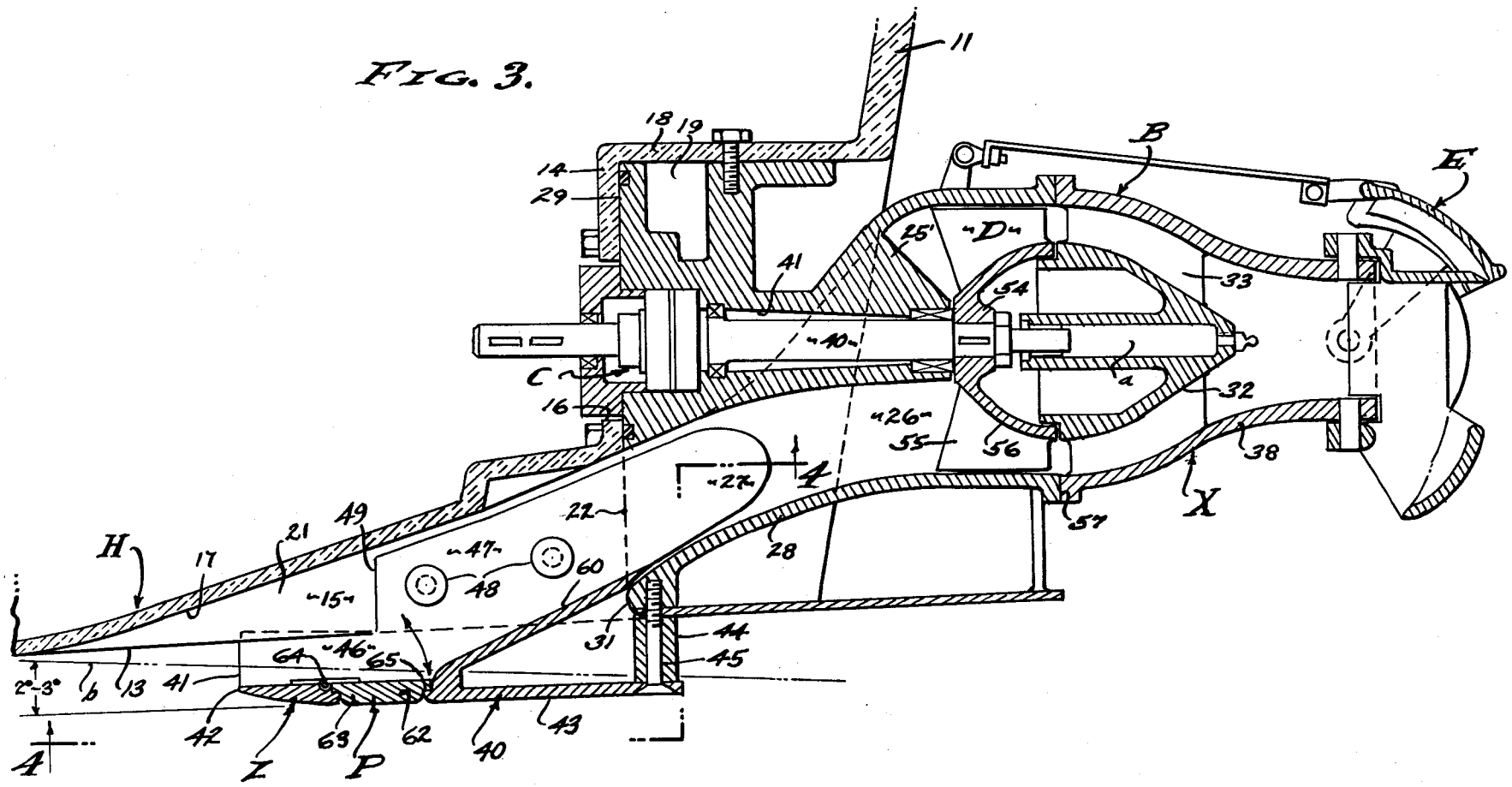
FIG. 3 is a reduced longitudinal sectional view taken as indicated by line 3—3 on FIG. 2.
Figure 4:
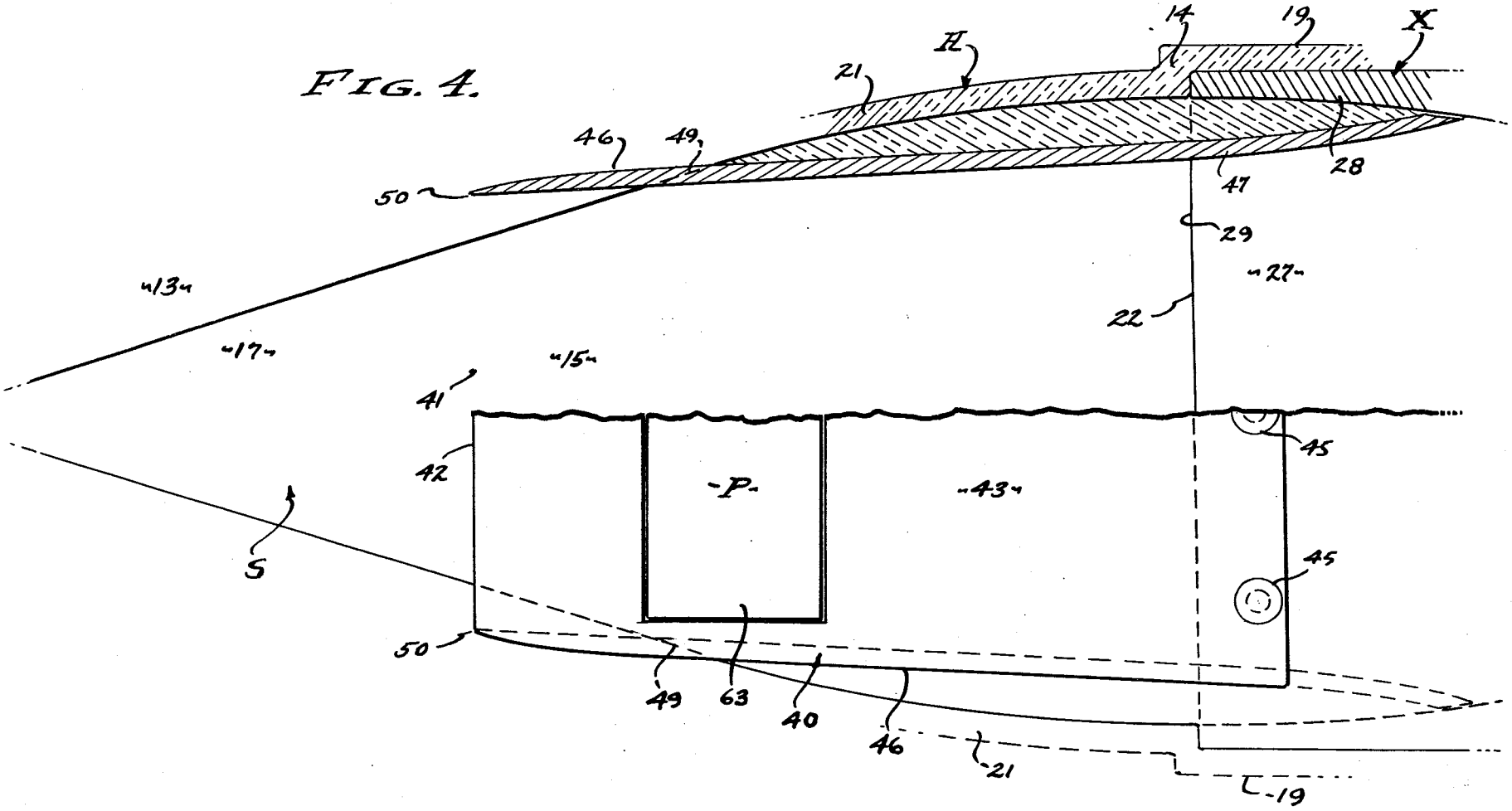

And, FIG. 4 is a bottom view of the hull-drive-scoop combination taken substantially as indicated by line 4—4 on FIG. 3.

PREFERRED EMBODIMENT

Figure 1:
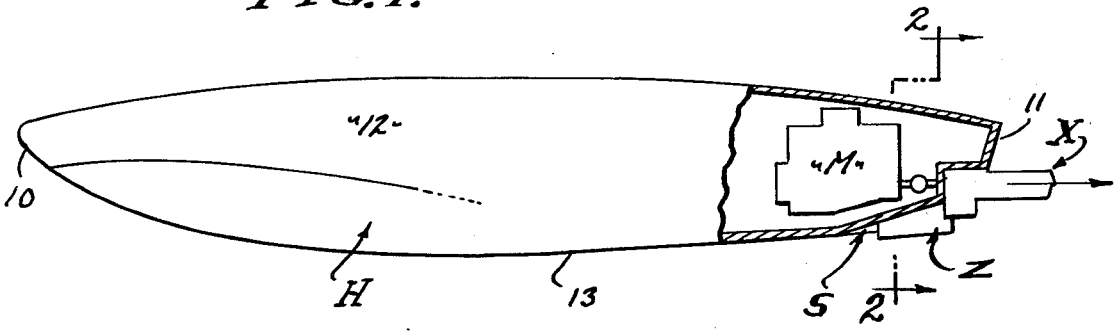
FIG. 1 is a side elevation of the combination of a boat hull and the hydrojet boat drive unit of the present invention.

The hydrojet boat drive X and ram-scoop Z of the present invention are removably installed at the exterior of the vessel or hull H to be propelled thereby. It is to be understood that the boat hull H can vary widely, a typical "V"-shaped hull as shown in FIG. 1 of the drawings. As shown, the hull H comprises a bow 10, a stern or transom 11, top-sides 12, and fair "V" bottom lines 13 that extend from bow to stern. A typical configuration is illustrated wherein the fair lines 13 of the bottom are generally flat and wherein the top-sides and bottom are truncated by a flat transverse transom 11 slanted upwardly and rearwardly.

In accordance with this invention, a slot S is formed in the hull H for accommodating the drive X as a unit, the slot comprising a bulkhead 14 and a tunnel 15. Although the bulkhead 14 can be disposed at various angles, it is preferred that it be vertically disposed for the reception of the mounting face of the drive unit, in which case there is a central opening 16 through the bulkhead for entry of the pump shaft into the hull 11 on a horizontal axis. Also, the tunnel 15 can be disposed at various angles of incidence, it being preferred that the top wall 17 of the tunnel be rearwardly inclined at 25°, more or less, where it terminates at the plane of the bulkhead 14. As shown where the transom 11 is rearwardly slanted, the bulkhead is recessed forwardly from the transom establishing a chest having a top 18 and side walls 19 to receive the pump housing of the unit. The walls 19 are suitably spaced to receive the cross section of the unit X and the tunnel 15 has side walls 21 that extend forwardly from said chest. Characteristically therefore, both the said chest and openly adjoining tunnel 15 are downwardly open with structurally reinforcing vertically disposed side walls continuing one into the other, and with the tunnel top 17 faired from the bottom lines 13 and tangentially with the top wall of the inlet plenum later described. It will be seen that the bulkhead 14 and tunnel 15 forming the slot S are easily formed and are structurally sound for the reception of both mounting and thrust forces to be imposed by the drive unit X, as well as drag forces impared by the ram-scoop Z.

The slot S is of substantial width and forms a wide-mouthed flush opening when combined with the pump housing to be described. Intake into the drive X is at the plane of joinder between the bulkhead 14 and the pump housing, there being an interface opening 22 at said plane between the bulkhead 14 and the pump housing. The divergent widening angle of the tunnel 15 is 30° to 36° (inclusive) as shown, for transmission of the intake propulsion water from the apex of the "V" bottomed hull H to the interface opening 22.

The hydrojet drive X is a pump unit that involves generally, a pump housing A, a stator housing B, bearing and seal means C, an impeller D, a nozzle E, and the necessary control means as indicated in the drawings. The housings A and B are separable with a flow passage 26 extending longitudinally therethrough in which the impeller D is journaled upon the bearing and seal means C on a horizontal axis. The nozzle E receives the pressure discharge of water from the stator housing and is carried thereby to directionally discharge the said water. Reverser means and steering means are independently operable and cooperatively carried by the nozzle as is shown.

The pump housing A is the main body of the unit and comprises the forward portion of the flow passage 26 establishing the interface opening 22 and entry plenum 27. The plenum 27 and continuing flow passage 26 are formed by a tubular side wall 28 of the housing A, the plenum 27 being inclined from the scoop 22 opening beneath the bearing means C at the front face 29 of said housing. The initial entry area at opening 22 is of low profile widened rectangular cross section which narrows and gains height as it inclines rearwardly to merge with a cylindrical wall of flow passage 26 surrounding the impeller. In practice, the inclination of plenum 27 is increased and/or curved upwardly and is then recurved around and to have an axis coincidental with the impeller axis a, as said plenum extends rearwardly and is faired into the flow passage 26. The interface opening 22 features a lower entry lip 31 that presents an oval-round leading edge for the usual entry through the slipstream of water passing beneath the boat hull and from the tunnel 15 therein. A hydrodynamic fin or blade-like fairing 25' occupies the flow passage space 26 between the wall 28 thereof from which the pump shaft 40 emerges and the impeller D or entry cone 56 thereof. The fairing 25' is a tubular extension of bore 41 that houses the pump shaft coextensively between its emergence to the entry cone, and from which a fin projects vertically on the center plane to meet the wall 28 and fully occupy the space therebetween above the pump shaft. Operationally, the fairing 25' straightens the flow of water into the impeller D and prevents wrapping of debris around the pump shaft 40, thereby enhancing the operation by preventing entanglements which otherwise might deposit around said pump shaft.

The entry lip 31 is substantially forward of the transom 11, by the provision of the recessed bulkhead 14. By this means the interface opening 22 is at the foremost plane of the pump housing A coincidental with the plane of bulkhead 14 and is immersed in water confined beneath the bottom 13; and all of which reduces the possibility of cavitation, especially when in the reverse mode of operation. The above described pump housing A is fastened directly to the slot S of the boat hull for its cantilevered support and to structurally participate in the beam strength of the boat hull. Accordingly, screw fasteners are entered into any one and preferably all four planar faces of the pump housing A that are fitted firstly to the bulkhead 14, secondly the top wall 18, and thirdly and fourthly to the opposite side walls 19.

The jet housing or stator housing B is separable from the pump housing A at the full diameter of the latter and in a plane normal to the impeller axis a. Broadly, the stator housing and elements carried thereby is a control means that directs the water pumped rearwardly therefrom. As shown, the two housings are joined by a bolted flange connection with the flow passage 26 continuing as an annulus defined by a re-entry cone 32 carried centrally therein by stator blades 33 extending radially between the tubular side wall 38 and said cone 32. The stator blades 33 have leading edges immediate to the plane of joinder between said housings and they are canted so as to receive the helical flow of water from impeller D and they are recurved to turn said flow of water axially and thereby pressurize the same. As shown, the wall 38 is converged over the re-entry cone 32 merging from the annular passage 26 to the nozzle E.

The impeller D is bladed for axial flow discharge of water through the annular flow passage 26, and to this end is comprised of a hub 54 from which helically canted blades 55 project radially so as to substantially occupy the annulus of passage 26. The hub 54 carries a fairing in the form of an entry cone 56 that distributes plenum water to flow unrestrictedly into the cylindrical portion of flow passage 26. The hub 54 is keyed to pump shaft 40 forwardly of the plane of joinder between housings A and B, and the cone 56 flairs outwardly and rearwardly therefrom to merge tangentially with the outer diameter of re-entry cone 32. In practice, the combined cones 32 and 56 are telescopically interengaged and sealed as by means of a labyrinth, or the like, and together they are generally ovular or egg-shaped in longitudinal cross section, and the trailing edges of the rotor blades 55 being juxtaposed closely to the leading edges of the stator blades 33. A pressure seal 57 is provided at the plane of joinder between the two housings when brought together to enclose the impeller.

The nozzle E is of limited axial extent and is incorporated in selectively positionable elements which are no part of the present invention. The directional control afforded by the nozzle E cooperatively relates reverse means and steering means as indicated in the drawings.

Referring now to the present invention, the ram-scoop Z is attached to the boat hull H and boat drive X, to modify the slot S and intake plenum 27 of the hull and drive respectively. That is, this invention provides a restrictive ram opening for high speed operation and provides augmented volume intake for low speed operation. Accordingly, there is provided the pressure responsive panel P inherently subject to any imbalance in pressure to open and to close a secondary intake opening as circumstances require. Therefore, when external slipstream pressure is greater than internal flow pressure within the ram-scoop Z the panel P opens so as to augment the volume of propulsion water to the drive X, and reversely when internal flow pressure is greater than external slipstream pressure the panel P closes so as to retain the ram pressure effect for higher speed operation. A feature of the ram-scoop configuration is its low profile, a discretely small protruberance from the apex mold line b of the boat bottom 13, thereby minimizing drag which in turn is advantageously employed toward achieving necessary directional stability.

The ram-scoop Z is in the nature of an adapter applicable to and used in combination with the boat hull H and boat drive X, and it comprises a shell-like housing 40 enclosing the slot S and attached to the drive X. In practice, the housing 40 extends forwardly from the lip 31 of the pump housing A to a transverse plane where it is spaced from the top wall 17 and within the confines of side walls 21 so as to establish an inlet 41 of the desired cross sectional configuration. For example, an opening nominally seven inches wide with a horizontal lip 42 disposed approximately three-quarter inch below the apex b of the "V" bottomed hull having approximately 15° deadrise to the chines of the hull (see FIG. 2). In the example shown, the housing 40 extends forwardly from lip 31 approximately twelve inches; the dimensions given being chosen for a prime mover developing approximately 300 h.p. (S.A.E.).

Figure 2:
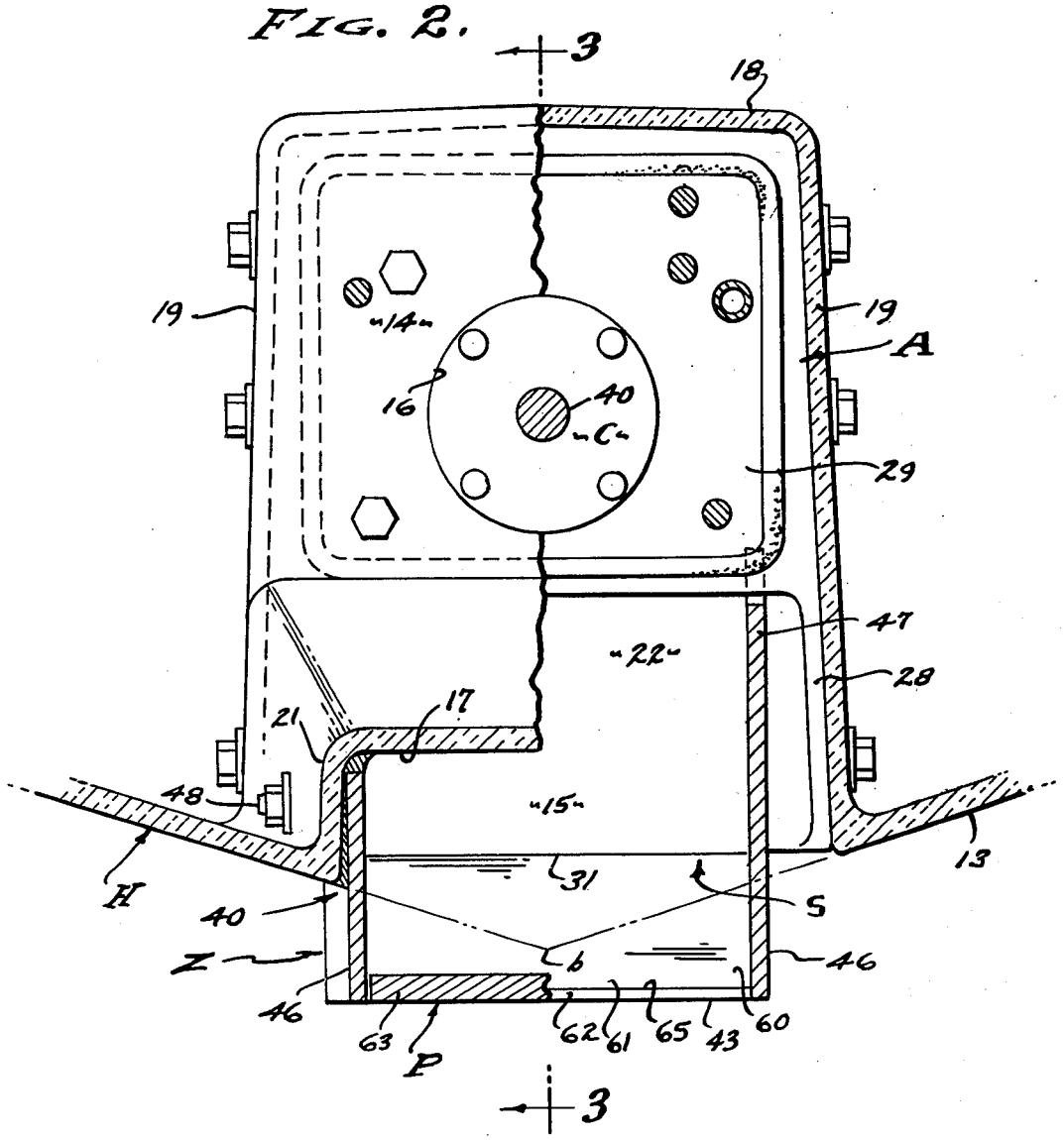
FIG. 2 is an enlarged transverse sectional view taken substantially as indicated by line 2—2 on FIG. 1.

The housing 40 with its lip 42 presents a flat bottom 43 forwardly and downwardly divergent from the apex b of the hull bottom approximately 2° to 3°, and attached to the lip 31 of pump housing A by stand-offs 44 secured by screw fasteners 45 or the like. The upper plane of bottom 43 is flat and the lip 42 substantially knife edged thereat, establishing an opening height of between two and one-quarter to three and one-quarter inches that will vary dependent upon jet nozzle area, ultimate speed and prime mover power. The opposite side edges of the housing 40 are joined to the hull bottom 13 by vertically disposed side walls 46 that extend therebetween to be secured into the hull H. The inside planes of the side walls 46 are flat with substantially knife edged lips 50 thereat in the transverse plane of the inlet 41 (see FIG. 4). A feature is the cheek plates 47 that extend into and occupy the tunnel 15 and plenum 27, projecting through the interface opening 22 to engage with the side walls of the tunnel and plenum respectively. In carrying out this invention it is the side wall configuration of the slot S and the cross sectional area of the interface opening 22 that are modified and/or reduced. Therefore, the aforementioned divergent tunnel widening angle of 30° to 36° is modified for example by the lesser widening angle of divergence of the side walls 46 of 6° (inclusive) as shown, and the interface opening 22 is reduced in width from a nominal ten inches to approximately eight inches, thereby establishing a nominal four by eight inch opening intake into the drive unit X. As best illustrated in FIGS. 2 and 3, the interface opening 22 is rectangular with flat sides against which the cheek plates 47 are angularly abutted, being truncated and/or beveled as required so as to fit the rounded transition of plenum 27. In practice, the trailing abutted edges of the cheek plates are outwardly turned and feather edged, as shown.

Where the side walls of the plenum are convergent and divergent, as shown, the space therebetween is filled with an epoxy resin or the like, and fasteners 48 are applied through the cheek plates 47 and into the boat structure side walls 21. The cheek plates 47 are notched at 49 to accommodate the transition from tunnel 15 to engagement of side walls 46 with the boat bottom 13. All intermediate openings and interstices are filled and/or closed by epoxy resins fills or the like, as indicated.

The flow passage established by the aforesaid adaptation of the ram-scoop Z to the slot S is characterized by its restrictive ram inlet 41 and widening cross sectional area which can deliver a greater volume of propulsion water through the interface opening 22. Accordingly, the transition between inlet 41 and opening 22 is gradual, the opening 22 being of substantially greater height and width (greater area) than inlet 41. As shown, a rearwardly inclined baffle 60 extends from the bottom 43 of the housing 40 to the lip 31 of pump housing A, slightly convergent with the top wall 17 of the tunnel 15, and establishing a forward continuation of plenum 27 or wall 28 of pump housing A. In practice, the baffle 60 is a flat member that converges with the bottom 43 to establish a transverse lip 61 coextensive with the width of housing 40, and forward of which there is a flush opening 62 disposed a substantial distance behind the ram-scoop lip 41. The flush opening 62 is also coextensive with and embraces the width of housing 40, a rectangular opening extending between the side walls 46.

In accordance with this invention, the panel P is provided to open and to close the flush opening 62 responsive to the demands of the boat drive X with respect to the imbalance of water pressure between the internal flow passage and external slipstream. Accprdingly, the panel P is an inwardly swinging plate 63 that forms a continuation of the bottom 43 coextensively of the flush opening 62. Therefor, the plate 63 is hinged to the forward edge of the opening and is stopped coplanar with the bottom 43. In practice, a piano type hinge 64 with its axis coincidental with the top plane of bottom 43 permits free swinging of plate 63 and stop shoulders 65 engage upwardly disposed complementary shoulders at the front and rear edges of opening 62 to accurately position the plate coplanar with said bottom, both interiorly and exteriorly. Therefore, the plate is free to swing upward for augmenting propulsion water flow when the ram inlet 41 would be inadequate at low boat speeds of operation; and is free to swing downward for containing propulsion water flow when the ram pressure is the greater pressure required for efficient high speed boat operation.

Having described only a typical preferred form and application of our invention, we do not wish to be limited or restricted to the specific details herein set forth, but wish to reserve to ourselves any modifications or variations that may appear to those skilled in the art as set forth within the limits of the following claims:

1. In combination:

a boat hull having a tunnel opening flush at the bottom thereof for the reception of propulsion water and inclined upwardly as it extends rearwardly to an interface opening at the stern thereof;

a hydrojet drive unit having a pump housing secured to the boat hull and with a propulsion water flow passage continuing rearwardly from a lip at the hull bottom and from said interface opening, and a prime mover driven impeller in said passage to deliver propulsion water through a nozzle;

and a ram-scoop extending forwardly from the lip of the hydrojet drive unit and with a planar bottom spaced below the hull bottom and enclosing the tunnel and defining a restricted inlet opening for high speed boat operation, there being a secondary inlet opening in the planar bottom of the ram-scoop and closed by a panel coplanar therewith and free to open in response to an imbalance between exterior slipstream pressure and interior tunnel pressure so as to augment the flow of propulsion water into the tunnel for low speed boat operation.

2. The boat hull, drive unit and ram-scoop combination as set forth in claim 1, wherein the panel closing said secondary inlet opening is hinged at its forward extremity to swing inwardly from a stopped and closed coplanar position.

3. The boat hull, drive unit and ram-scoop combination as set forth in claim 1, wherein the secondary inlet opening is positioned substantially forward of the interface opening at the stern of the boat hull into the drive unit flow passage, there being a rearwardly inclined baffle extending from the said secondary inlet opening to the said interface opening.

4. The boat hull, drive unit and ram-scoop combination as set forth in claim 1, wherein the ram-scoop is of low profile configuration disposed below the boat hull tunnel and transversely embraces the same.

5. The boat hull, drive unit and ram-scoop combination as set forth in claim 1, wherein the boat hull tunnel is laterally divergent as it inclines rearwardly, and wherein the ram-scoop is of substantially uniform cross section and transversely embraces said boat hull tunnel enclosing the passage of propulsion water therethrough.

6. The boat hull, drive unit and ram-scoop combination as set forth in claim 1, wherein the boat hull tunnel is laterally divergent as it inclines rearwardly, and wherein the ram-scoop is comprised of said planar bottom and side walls less divergent than side walls of said tunnel and restricting the interface opening laterally.

7. The boat hull, drive unit and ram-scoop combination as set forth in claim 1, wherein the boat hull tunnel is laterally divergent as it inclines rearwardly, and wherein the ram-scoop is comprised of said planar bottom underlying the tunnel and side walls extending to the boat hull adjacent the tunnel, there being cheek plate extensions of the ram-scoop side walls entering the tunnel and fastened to the side walls thereof for securement of the ram-scoop to the boat hull.

8. The boat hull, drive unit and ram-scoop combination as set forth in claim 1, wherein the ram-scoop is fastened to the drive unit pump housing and is comprised of said planar bottom underlying the tunnel and side walls extending to the boat hull adjacent the tunnel and fastened thereto.

9. The boat hull, drive unit and ram-scoop combination as set forth in claim 1, wherein the secondary inlet opening is positioned substantially forward of the interface opening at the stern of the boat hull and is of low profile configuration and transversely embraces the tunnel, there being a rearwardly inclined baffle extending from the said secondary inlet opening to the said interface opening, and wherein the panel closing said secondary inlet opening is hinged at its forward extremity to swing inwardly from a stopped and closed planar position.

10. The boat hull, drive unit and ram-scoop combination as set forth in claim 1, wherein the boat hull tunnel is laterally divergent as it inclines rearwardly, wherein the ram-scoop is comprised of said planar bottom disposed beneath the hull bottom and extending forwardly from the said interface opening and is of low profile configuration with side walls extending from said planar bottom and to the boat hull adjacent the tunnel and fastened to side walls thereof and to the drive unit pump housing for securement of the ram-scoop to the boat hull.

11. In combination:

a "V" bottomed boat hull having a tunnel commencing at the apex of said "V" bottom and opening rearwardly and flush therealong for the reception of propulsion water and inclined upwardly as it extends rearwardly to an inteface opening at the stern thereof;

a hydrojet drive unit having a pump housing secured to the boat hull and with a propulsion water flow passage continuing rearwardly from a lip at the hull bottom and from said interface opening, and a prime mover driven impeller in said passage to deliver propulsion water through a nozzel;

and a ram-scoop extending forwardly from the lip of the hydrojet drive unit and with a planar bottom spaced below the apex of the "V" bottom of the boat hull and enclosing a rear portion of the tunnel and defining a restriced inlet opening for high speed boat operation and exposing a forward portion of said tunnel, there being a secondary inlet opening in the planar bottom of the ram-scoop and closed by a panel coplanar therewith and free to open in response to an imbalance between exterior slipstream pressure and interior tunnel pressure so as to augment the flow of propulsion water into the tunnel for low speed boat operation.

12. The boat hull, drive unit and ram-scoop combination as set forth in claim 11, wherein the panel closing said secondary inlet opening is hinged at its forward extremity to swing inwardly from a stopped and closed coplanar position.

13. The boat hull, drive unit and ram-scoop combination as set forth in claim 11, wherein the secondary inlet opening is positioned substantially forward of the interface opening at the stern of the boat hull into the drive unit flow passage, there being a rearwardly inclined baffle extending from the said secondary inlet opening to the said interface opening.

14. The boat hull, drive unit and ram-scoop combination as set forth in claim 11, wherein the ram-scoop is of flat bottomed low profile configuration disposed below the rear tunnel portion and transversely embraces the same.

15. The boat hull, drive unit and ram-scoop combination as set forth in claim 11, wherein the boat hull tunnel is laterally divergent as it inclines rearwardly, and wherein the ram-scoop is of substantially uniform cross section and transversely embraces said boat hull tunnel enclosing the rear tunnel portion for passage of propulsion water therethrough.

16. The boat hull, drive unit and ram-scoop combination as set forth in claim 11, wherein the boat hull tunnel is laterally divergent as it inclines rearwardly, and wherein the ram-scoop is comprised of said planar bottom and straight side walls less divergent than side walls of said tunnel and restricting the interface opening laterally.

17. The boat hull, drive unit and ram-scoop combination as set forth in claim 11, wherein the boat hull tunnel is laterally divergent as it inclines rearwardly, and wherein the ram-scoop is comprised of said planar bottom underlying the tunnel and straight side walls extending to the "V" bottom of the boat hull adjacent the tunnel, there being cheek plate extensions of the ram-scoop side walls entering the tunnel and fastened to the side walls thereof for securement of the ram-scoop to the boat hull.

18. The boat hull, drive unit and ram-scoop combination as set forth in claim 11, wherein the ram-scoop is fastened to the drive unit pump housing and is comprised of said planar bottom underlying the tunnel and side walls extending to the "V" bottom of the boat hull adjacent the tunnel and fastened thereto.

19. The boat hull, drive unit and ram-scoop combination as set forth in claim 11, wherein the secondary inlet opening is positioned substantially forward of the interface opening at the stern of the boat and is of flat low profile configuration and transversely embraces the tunnel, there being a rearwardly inclined baffle extending from the said secondary inlet opening to the said interface opening, and wherein the panel closing said secondary inlet opening is hinged at its forward extremity to swing inwardly from a stopped and closed coplanar position.

20. The boat hull, drive unit and ram-scoop combination as set forth in claim 11, wherein the boathull tunnel is laterally divergent as it inclines rearwardly, wherein the ram-scoop is comprised of said planar bottom disposed beneath the hull bottom and extending forwardly from the said inteface opening and is of low profile configuration with side walls extending from the planar bottom and to the "V" bottom of the boat hull adjacent the tunnel and fastened to side walls thereof and to the drive unit pump housing for securement of the ram-scoop to the boat hull.

* * * * *